US005994683A

United States Patent [19]

Braunisch et al.

[11] Patent Number: 5,994,683

[45] Date of Patent: Nov. 30, 1999

[54] CONTAINER SENSING SYSTEM AND MICROWAVE OVEN USING THE SAME

[75] Inventors: Eckart Braunisch, Kimstad; Krister Gindahl, Linkoping, both of Sweden

[73] Assignee: Whirlpool Corporation, Benton Harbor, Mich.

[21] Appl. No.: 08/894,289

[22] PCT Filed: Feb. 27, 1996

[86] PCT No.: PCT/EP96/00797

§ 371 Date: Nov. 21, 1997

§ 102(e) Date: Nov. 21, 1997

[87] PCT Pub. No.: WO96/27272

PCT Pub. Date: Sep. 6, 1996

[30] Foreign Application Priority Data

Feb. 28, 1995 [SE] Sweden ..... 9500736

[51] Int. Cl.[6] ..... H05B 6/68

[52] U.S. Cl. ..... 219/704; 219/711; 219/714; 219/502; 219/756; 374/149; 99/325; 426/88

[58] Field of Search ..... 219/710, 711, 219/714, 506, 494, 502, 720, 756; 116/216; 374/126, 130, 149, 150; 99/325, DIG. 14, 451; 426/88

[56] References Cited

U.S. PATENT DOCUMENTS

| | | | |
|---|---|---|---|
| 3,451,254 | 6/1969 | Maley | 374/126 |
| 4,144,758 | 3/1979 | Roney | 374/126 |
| 5,011,042 | 4/1991 | Bunce et al. | 219/714 |
| 5,426,280 | 6/1995 | Smith | 219/720 |
| 5,504,311 | 4/1996 | DuBuis et al. | 219/714 |

FOREIGN PATENT DOCUMENTS

| | | | |
|---|---|---|---|
| 58-193028 | 11/1983 | Japan | 219/714 |
| 2052731 | 1/1991 | United Kingdom | G01K 11/12 |

*Primary Examiner*—Philip H. Leung
*Attorney, Agent, or Firm*—Joel M. Van Winkle; Robert O. Rice; Stephen D. Krefman

[57] ABSTRACT

A container sensing system for controlling the heating in a microwave oven of a container carrying control information which may be read by an optical reading device. The optical reading device includes a light transmitter and a light receiver for sensing a reflectance of a sensor. The sensor includes a first and second region. The first region is provided for establishing a start and non-start condition while the second region is provided for reading temperature information. To avoid the surface reflected portion of incident light to gain an accurate reading, the axes of transmission and reception are offset in the same angular direction to a perpendicular of a sensor surface wherein the transmitter directs an inclined reading light beam onto a region of the sensor and the receiver receives the scattered light therefrom depending on the reflection properties of the sensor region.

11 Claims, 3 Drawing Sheets

CONTAINER SENSING SYSTEM AND MICROWAVE OVEN USING THE SAME

The invention is concerned with a container sensing system for controlling start and stop of a heating progress in a microwave oven, said system comprising an optical reading device including a light transmitter and a light receiver, a control information sensor provided on said container, and a control unit, said reading device reading said sensor in the cavity before and during heating and furnishing read control information to the control unit. The invention further concerns with a microwave oven comprising the container sensing system and its use in a special purpose microwave oven.

TECHNICAL BACKGROUND AND PRIOR ART

JP 609 4244-A2 discloses a microwave oven and a specifically designed cooking vessel, which has been provided with thermo-colour fields arranged around a periphery of the round vessel. A reflection type light sensor is provided for detecting a change of colour of said thermo-colour. By means of this feedback information a heating operation of a beverage or foodstuff in said container may be controlled.

GB 20 52 731-A discloses in general terms a set-up of a temperature responsive device in which light from a light source is directed towards a sensor of which the reflective characteristics changes with temperature. Reflected light from the sensor and received by a receiver provides information about such changes by temperature.

U.S. Pat. No. 5,285,041 discloses an automated food vending system comprising a microwave oven provided with a code reader for reading a bar code printed on a package.

Navy Technical Disclosure Bulletin, vol.10, no.1, Sep. 1, 1984, Arlington, Va. USA, pages 75–79,XP002006334 T. R. Odgen "Liquid Crystal Temperature Measurement Device" discloses a measurement apparatus for detecting the temperature of surfaces coated with thermographic liquid crystals, which can operate in water.

U.S. Pat. No. 4,933,525 discloses a microwaveable container provided with a plurality of liquid crystal film display devices which change colour in response to a preset temperature.

A general problem when using optical sensing/reading devices of the actual type is to establish a sustainable security in reading. Mainly this may be referred to the fact that the information carrying differences in the received reflected light may be small and therefore difficult to detect. Possibly this may be solved by the use of a more complicated light receiver including means for a deeper analysis of the spectrum of the received light, changing when the thermo sensitive surface changes colour at a temperature increase, for example. However, this further complication and increased costs therefore are highly undesirable in a consumer type equipment like a microwave oven. Another, related problem is that an accurate positioning of the cooking vessel or container, more specifically the sensor or sensors thereof, is required in relation to the light source and light receiver in order to obtain the symmetrical arrangements disclosed in said references, i.e. transmitting a light beam of a given angular off-set in relation to a perpendicular of the sensor surface and receiving a reflected beam of the same but opposite angular off-set.

In order to maintain the reflective characteristic of the sensor surface it is generally necessary to provide the sensor surface with a transparent cover layer or coating. In case the thermo-colour has been realized by means of a liquid crystal, such a transparent cover is a pure necessity. The use of this cover has the consequence that the amount of light in the surface reflected light beam will substantially not change with changes of the underlying thermo-colour. This problem is specifically focused in case of disposable type containers or packages regularly having a coating of this type. Moreover, use of packages or containers of this type further aggravates said sensor positioning problem, because the container wall and thereby the sensor carrying surface may bulge, thereby disturbing the reception of a symmetrically reflected reading beam.

Another problem in case of disposable containers is that non-approved packages may wrongly be interpreted as approved ones, which may lead to an unintended start of the heating progress with consequent risks for the user. Still another user risk may occur if a user inadvertently places an empty approved-type container in the oven. Within seconds this may lead to development of smoke and open fire.

These problems have neither been discussed in the referenced prior art, nor solved thereby.

SHORT DESCRIPTION OF THE INVENTION

A first object of invention is to eliminate the shortcomings of the sensor reading method disclosed in the prior art references, and to provide a method making possible a use of a secure evaluation of the read-out information of the received light or radiation by means of uncomplicated technical means.

This object of invention is obtained by means of a container sensing system as outlined in the introductory part of this specification, wherein a cooperating pair of a light transmitter and a light receiver of which axis of transmission respectively reception have off-set angles in the same angular direction relative to a perpendicular of the sensor surface, said transmitter directing thereby an inclined reading light beam onto a region of said sensor, and the receiver receiving scattered light from the same region of an amount which depends on the reflection properties thereof. This arrangement of the light transmitter and light receiver has the advantage that the surface reflected part of the incident light will not reach the receiver. Instead, the read-out of the sensor information is based on the scattered or diffused light emitted by the substance covering the sensor region, the amount of which will change when the reflection properties of said substance changes, and this to a degree which is easy detectable by simple technical means like a photo transistor.

The second object of invention is to obtain a container sensor system making possible a separation between containers or packages of an approved type and non-approved ones, thereby also allowing for a start condition of improved safety to be established.

This object of invention is obtained by a container sensing system, wherein said sensor is provided with a first sensor region and a second sensor region, said sensor device comprising a first and a second light transmitter/receiver pair, said first pair being arranged for reading a container type information of said first sensor region for establishing a start or non-start condition, said second pair being arranged for reading a temperature information of said second sensor region for establishing stop of heating condition at a desirable ready-temperature of foodstuff or beverage in said container. The introduction of a container type indicating region of the sensor eliminates the risk of damages that may follow from the use of a non-approved container, and, in respect of user security, consumption of not properly prepared foodstuff or beverage, as well as technical damage of the oven. A further improvement may be obtained according to a preferred embodiment of the invention, wherein said start or non-start condition is based on the combined read informations from both said sensor regions.

The security of reading of said sensor may be further improved by a proper selection of the reflection properties or reflectances of the different substances used for said sensor regions according to another embodiment of the invention, wherein said first sensor region comprises a substance of permanently low, alternatively high, reflectance of incident light, said second region comprises a temperature sensitive substance of a reflectance that changes from high to low for the light wavelengths used, alternatively low to high, at the ready-temperature, said highs and lows being referred to a calibrated reference level of a value between the reflectance levels of said temperature sensitive substance below respectively above the ready-temperature.

Further features of the invented container sensing system and advantages thereof are evident from the appended claims and the detailed description that follows below.

A microwave oven according to the invention, having an oven cavity, a microwave source for supplying microwaves to the cavity via a feeding arrangement, a control unit for controlling the microwave supply to the cavity, is provided with a reading device of the container sensing system as claimed for reading a sensor of a system-compatible container or package put into the oven cavity for heating purposes, said oven control unit integrating the control unit of the claimed sensing system and being furnished with read control information from said reading device. The invented microwave oven has the advantage of a drastically simplified and thereby cost-effective control system as implemented by the invented container sensing system. This is specifically advantageous for the manufacture of special-purpose microwave ovens with a cavity of design that has been fitted to the exterior of a specified type of packagings.

The invention is based on the recognition that readout of a package sensor as well as the means therefor may be optimized in respect of quality of the read-out information as well as low cost level by a careful mutual adaption of the reading device arrangement and the design and reflection properties of said sensor.

DESCRIPTION OF DRAWINGS

The invention will be more closely described in the following in relation to a non-limitative embodiment thereof with reference to the drawings, in which.

Corresponding parts in the different Figures have been provided with identical references.

DESCRIPTION OF EMBODIMENT

Figure 1:
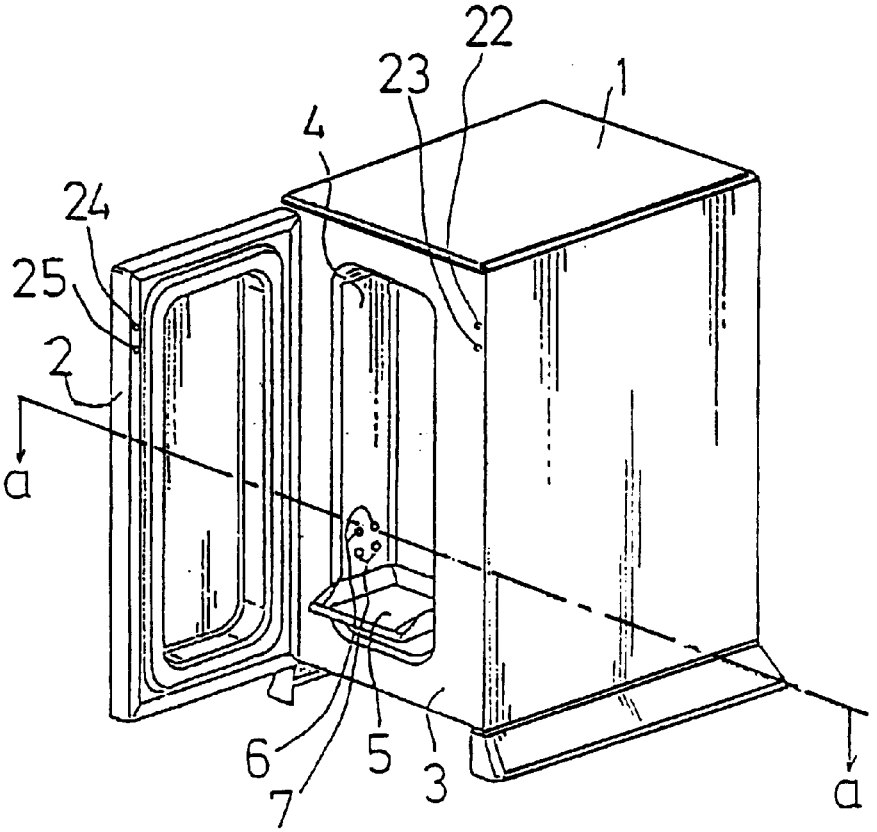
FIG. 1 discloses a microwave oven according to the invention.

FIG. 1 discloses an exemplifying type of a microwave oven which is specifically adapted for heating of beverages or foodstuff in their packages or containers. The adaption of the oven means that the oven cavity thereof has dimensions which have been adapted to the exterior of the package in such a way that the cavity is substantially filled out by the same. The oven comprises a housing 1, an oven door 2, an oven front 3, to which the oven door 2 adjoins in its closed position, and an oven cavity 4. At the bottom of the cavity there is a tray-shaped positioning means or load carrier 5 for an accurate positioning of a package in the cavity.

Inside the housing 1 the oven is provided with an ordinary magnetron for microwave generation, a microwave feeding arrangement for feeding the microwaves into the cavity 4, a fan arrangement for cooling the magnetron, an electronic control unit which is microprocessor based and a power supply for supplying high voltage to the magnetron and other operation voltages to the oven. Furthermore the oven is provided with a door switch, which in normal manner is operated by the door movement. Because said component parts of the oven have no importance for a closer understanding of the invention, the same will not be described herein. Instead is referred to SE patent No. 9002128-5, describing a microwave oven of the actual type, and further to the numerous microwave oven types manufactured and sold by the applicant during several years, specifically the ovens of the type designations VIP 20 and VIP 27.

The left sidewall of the cavity 4 comprises two pairs of horizontally arranged holes in the cavity wall, of which a first upper pair 6 and a second lower pair 7, the level of said pairs of holes being adapted to the position of the sensor of the container when correctly positioned on the carrier 5. The vertical shift between said pairs of holes is fitted to the vertical displacement between the two information regions of the sensor (see FIG. 2). The size of the holes is such that leaking of microwaves from the cavity 4 through the holes 6, 7 is practically prevented.

The oven front 3 is provided with two circular holes 22 respectively 23. Behind hole 22 is provided a light emitting diode emitting yellow light during the heating progress, green light when the heating is ready and stopped, and red light in case of an "error" condition. With door 2 in its closed position said light signals are transferred to the front side of door 2 via a light conductor represented by circle 24. Behind hole 23 of the oven front is provided a current supply switch, which may be operated by means of a pin represented by circle 25, which may be pushed into hole 23 from the front side of door 2. Furthermore the oven is provided with built-in alarm buzzer providing an audible signal of a different character for "heating ready" respectively "error". The operation of said light emitting diode and said buzzer is controlled by the oven control unit.

Figure 2:
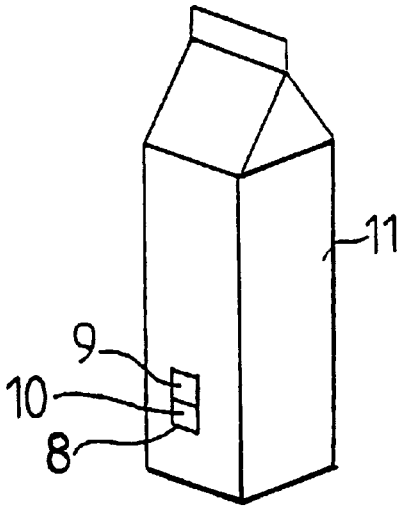
FIG. 2 discloses a container or package carrying a sensor according to the invented sensing system, FIG. 3 schematically discloses the reflection properties of a double-layer sensor, FIG. 4 discloses a partial sectional view a—a of the oven in FIG. 1, FIG. 5 discloses the main functional blocks of a container sensor controlled microwave oven according to the invention, and FIG. 6 discloses a flow chart of a heating progress in the microwave oven according to the invention.

FIG. 2 discloses a container or package of a type that is compatible with the sensing system according to the invention, carrying on one side a control information sensor label 8. The container is built from a microwave transmitting material, which is suitable for the intended use. The exterior of the container is covered by a transparent, e.g. polyester or polyprylene surface layer or coating. The sensor label 8 has a first sensor region 9 comprising a substance of permanent reflectance indicating an approved type of container, and a second region 10 comprising a substance of which the reflectance is temperature dependent, in this case a liquid crystal layer.

Figure 3:
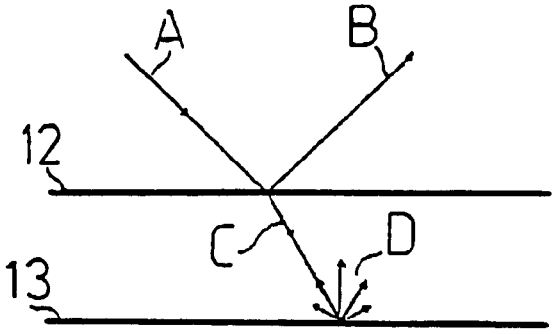

FIG. 3 schematically discloses the reflection of incident light against the liquid crystal sensor label 8 of the container 11. Line 12 represents the surface of the polyester coating and line 13 represents the liquid crystal surface. A represents incident light, B the symmetrically surface reflected light, C incident light diffracted by surface 12, and arrows D light which is scattered by the liquid crystal layer 13. The amount light which may be received by a light receiver in the direction of the surface reflected light B will show a relatively very small contribution of scattered light D. Therefore, it is difficult to detect a change of the scattered light contribution due to a change of the liquid crystal layer by an evaluation of a combination of surface reflected light B and scattered light D. This problem is solved by the invention.

Figure 4:
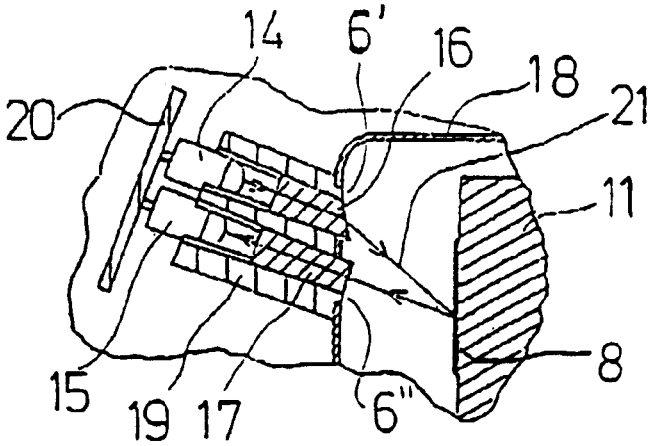

FIG. 4 discloses a partial cross section along line a—a in FIG. 1 including a cross-section of the first light transmitter/receiver pair. This cross-section discloses the container 11 and the sensor label 8 thereof. The cavity 4 is represented by the cavity wall 18 provided with said two holes 6, here represented by a hole 6' for the transmitted light and a hole 6" for reflected light. A light emitting diode 14 as said transmitter and a phototransistor 15 as said receiver are provided on a circuit board 20. A first lens means 16 is provided in the light path of the light emitting diode 14, and a second lens means 17 is provided in the light path of the phototransistor 15.

The light emitting diode 14, the phototransistor 15 and said lenses 16, 17 are carried by a support 19, which is fixed to the cavity wall with an airtight fit into said holes 6', 6". This airtight fit is necessary because of the overpressure established between the oven housing and the cavity by the fan for cooling the microwave generating magnetron. This overpressure would otherwise penetrate into the cavity and disturb the function of the temperature sensitive region of label 8.

The light path from the light emitting diode 14 via the lens means 16, reflection on said label 8, via the lens means 17, to the phototransistor 15, has been indicated by arrows 21. In this embodiment the axis of the illuminating light beam has an angular deviation from a perpendicular of the sensor surface which is about 40°, and the axis of the received light path has an angular deviation in the same direction of about 20°. The distance between the cavity wall and package is a space which is required by the tray-shaped carrier 5.

Figure 5:
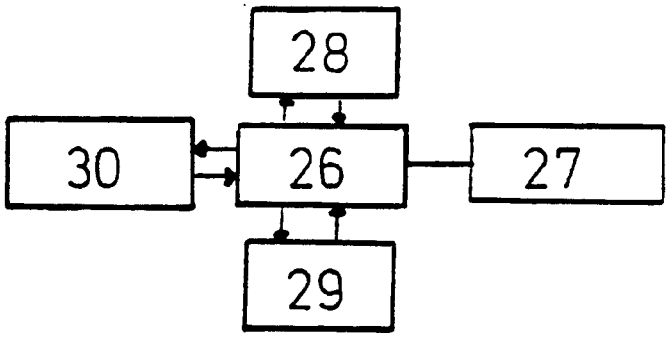

FIG. 5 discloses the main functional blocks and the communication paths between these blocks in the container sensor controlled microwave oven according to the invention. Block 26 represents the programmed microprocessor control unit of the oven, which controls the microwave supply from the magnetron 27. Control unit 26 recieves operator's commands from the operator panel 28 on the front side of the oven door 2, meaning in this embodiment information about the position of the switch behind the hole 23, and returns control of the light emitting diode behind the hole 22. The reading device 30 of the container sensing system furnishes read control information to the control unit 26, and receives control information therefrom for running a sensing cycle of the sensing device. The control unit 26 communicates with a memory 29, storing necessary control software for running the operation of the oven as well as a calibrated reflectance reference level needed for establishing the reflectances of the sensor regions as high or low.

Due to the variation of the characteristics of the optical components used in the sensing device, it is necessary to perform a calibration of each separate reading device in order to establish the reference level, to be used for the evaluation of the read information. This is done during manufacture of the oven by reading a package having maximum permissible reflectance level and adjusting the "amplification" of the reading device based thereon; thereafter establishing a "high" reflectance level by reading a surface of normal reflectance value of the sensor label below its transition temperature; establishing a "low" reflectance level by reading a surface of a reflectance which is normal of said sensor above its transition temperature; for each pair of light emitting diode/phototransistor a reference level is calculated of a value between said "high" and "low" levels; this reference level is stored in a non-volatile memory (29).

Figure 6:
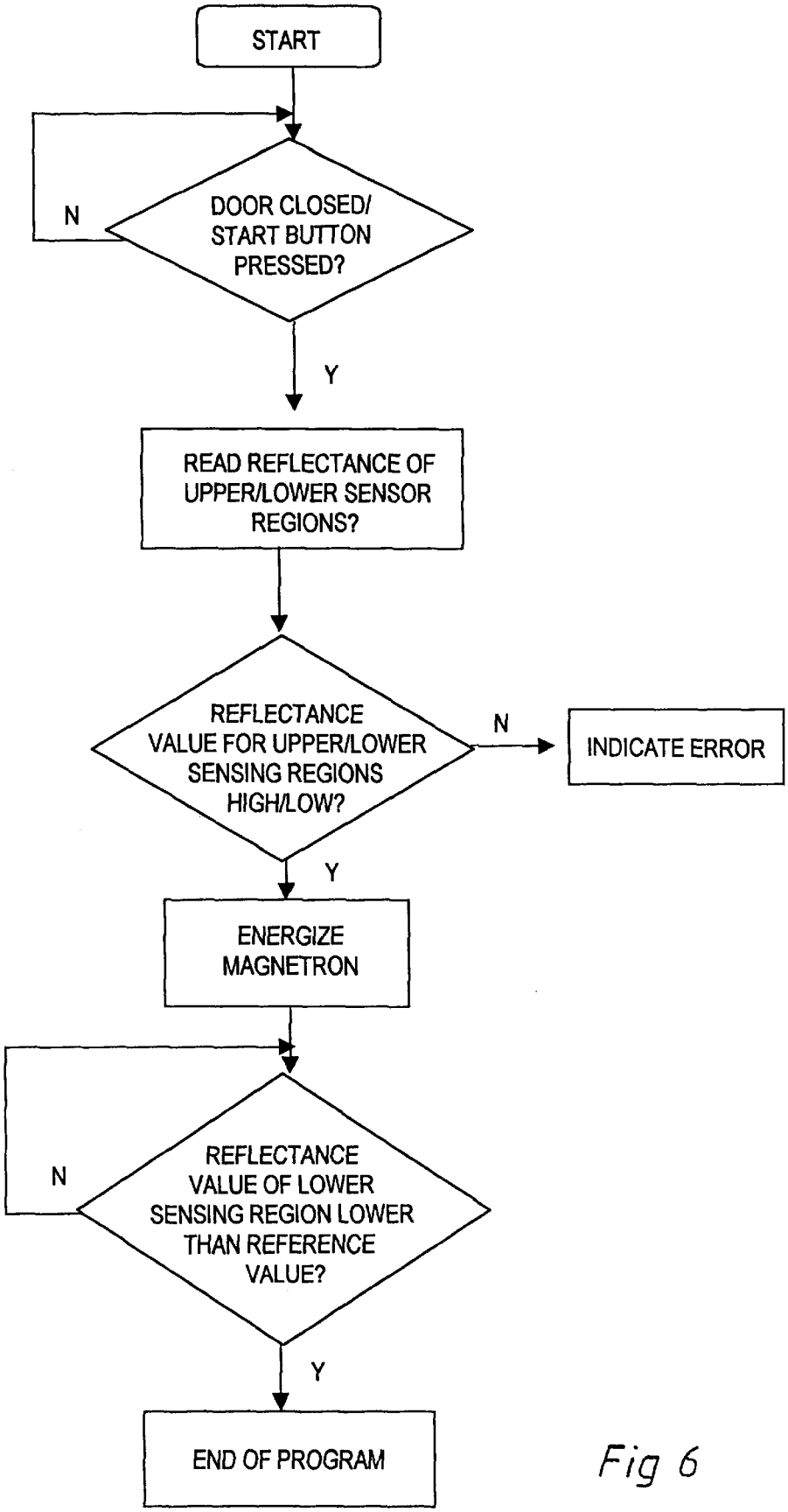

FIG. 6 discloses a flow chart of a heating progress in the microwave oven according to the invention. The following steps are included:

1. Start of progress.
2. Door closed and start button pressed? (Position of door is detected by a common type door switch)
   if "yes" (Y), proceed to step 3
   if "no" (N), return to step 2
3. Read reflectance of upper and lower sensor regions by the following substeps:
   a. sensing the level of ambient light received from the first region (9) with both light transmitters inactive
   b. sensing the level of light received from the first region (9) with first light transmitter active
   c. sensing the level of ambient light received from the second region (10) with both light transmitters inactive
   d. sensing the level of light received from the second region (10) with the second light transmitter active
   e. determining a respective reflectance value of the first and the second regions by subtracting the value of step a. from the value of step b., respectively the value of step c. from the value of step d.
4. Establishing said reflectance values as high or low in relation to said reference value by questioning:
   Reflectance value of upper region smaller than calibrated reference level, and reflectance level of lower region higher than calibrated reference level?
   if "yes" (Y), proceed to step 5
   if "no" (N), indicate "error"("error"=seven sound impulses and twinkling red from diode 22 on operator's panel)
5. Start heating progress by activating magnetron 27
6. Reflectance of lower sensor region smaller than calibrated reference level?
   if "no" (N), return to step 6
   if "yes" (Y), proceed to step 7.
7. Stop heating, indicate "ready" ("ready"=three sound impulses and green from diode 22 on operator's panel)
   End of progress The read-out evaluation of reflectance levels of the upper and lower sensor regions during steps 3. and 4., may give the following four different results:

| | Upper Region | Lower Region |
|---|---|---|
| 1. | low | low |
| 2. | low | high |
| 3. | high | low |
| 4. | high | high |

"high" = reflectance value above reference level
"low" = reflectance value below reference level A start condition which allows start of the oven only in case 2., that is a low reflectance of the upper region 9 together with a high reflectance of the lower region, substantially improves security by practically eliminating risks of using non-approved packages, because the chances of a non-approved package or container having occasionally this combination of reflectances in positions corresponding to said sensor regions is practically null.

In order to improve the user security even further the reflectance value of the upper permanent region 9 may be sensed repeatedly during the cycle which is illustrated in FIG. 6. If a change occurs of its normally permanent reflectance, this will be evalutated as an emergency situation like development of smoke or open fire, which may be used for an interupt of heating. This situation might occur if a user by mistake places an empty approved type container in the oven. Heating will start and smoke and flames will occur within a few seconds because the microwave energy will concentrate to the adhesive substance used for closing the package, thereby overheating adjoining parts of the container, leaving the temperature sensitive region uninfluenced by microwave energy and thereby inactive.

The man skilled in the art will understand that the sensing system according to the invention based on "inclined illumination and viewing angles" may be useful in other applicatins than sensing a container in a microwave oven. Likewise he will appreciate that the necessary software programming for the microprocessor based control unit, being of the same nature as used before in the referenced microwave ovens, lies well within the limits of his skills.

We claim:

1. A container (11) sensing system for controlling start and stop of a heating progress in a microwave oven (1), said system comprising:

a control information sensor (8) provided on said container, said sensor (8) includes a first region having a low reflectance substance and a second region (10) having a temperature sensitive substance which changes its reflectance from a high reflectance to a low reflectance in response to an increase in temperature, an optical reading device comprising a first and a second light transmitter (14) and light receiver pair (15), said first pair being arranged for sensing reflectance of light from said first region (9) for establishing a start, non-start or terminate condition, said second pair being arranged for sensing reflectance of light from said second sensor region (10) for establishing a stop of heating condition at a desirable ready-temperature of a foodstuff or beverage in said container, a control unit (26) operating said reading device for reading said first region (9) and said second region (10) before and during heating such that control information is supplied to said control unit, and said light transmitter (14) and said light receiver (15) having axes of transmission respectively which have offset angles in the same angular direction relative to a perpendicular of the sensor surface, said transmitter directing thereby an inclined reading light beam onto a region of said sensor, and the receiver receiving scattered light from the same region of an amount which depends on the reflection properties thereof.

2. A container sensing system as claimed in claim 1 characterized by said control unit (26) being condition based on combined read information from both said regions (9, 10).

3. A container sensing system as claimed in claim 1 characterized by said first sensor region (9) comprising a substance of permanently low, alternatively high, reflectance of incident light, said second region (10) comprising a temperature sensitive substance of a reflectance that changes from high to low, alternatively low to high, at the ready-temperature, said highs and lows being referred to a calibrated reference level of a value between the reflectance levels of said temperature sensitive substance below respectively above the ready-temperature.

4. A container sensing system as claimed in claim 3, characterized by said first sensor region (9) comprising a permanently black substance of low reflectance, and said second sensor region (10) comprising a temperature sensitive substance that changes from high reflectance at room temperature to low reflectance above the ready-temperature, both substances being covered by a transparent coating.

5. A container sensing system as claimed in claim 4, characterized by said temperature sensitive substance being a liquid crystal changing from high reflectance to low reflectance.

6. A container sensing system as claimed in claim 1, characterized by, in each of said pairs, a green light emitting diode (14) and a phototransistor (15) providing said light transmitter respectively said light receiver, a first lens means (16) being arranged in the path of said reading beam for directing the same on the sensor region (9; 10), a second lens means (17) being arranged for collecting scattered light and directing the same to the photo transistor.

7. A containing system as claimed in claim 1, wherein the microwave oven includes a cavity and said first and second light transmitter/receiver pairs are arranged with a vertical separation outside the cavity wall for reading of likewise vertically separated regions of said sensor via respective holes (6, 7) in the cavity wall.

8. A container sensing system as claimed in claim 7, said light transmitter/receiver pairs and lens means thereof being carried by a support means (19) providing an airtight fit to said holes (6, 7).

9. A method for operating a container sensing system for controlling the start and stop of a microwave oven wherein the sensing system includes a container having a control information sensor (8) having a first sensor region (9) and a second sensor region (10), a control unit (26) and an optical reading device including a pair of light transmitters (14) and a light receiver (15) of which the axes of transmission respectively reception have offset angles in the same angular direction relative to a perpendicular of the sensor surface, the control unit (26) setting a reflective value for the first region (9) and the second region (10), the method for operating a container sensing system comprising the following steps:

a. sensing the level of ambient light received from the first region (9) with both light transmitters inactive;

b sensing the level of light received from the first region (9) with first light transmitter active;

c sensing the level of ambient light received from the second region (10) with both light transmitters inactive;

d sensing the level of light received from the second region (10) with the second light transmitter active;

e determining a respective reflectance value of the first and the second regions by subtracting the value of step a. from the value of step b., respectively the value of step c. from the value of step d. and f. establishing said reflectance values as high or low in relation to said reference value.

10. The method for operating a container sensing system as claimed in claim 9, wherein said first and second regions have a low respectively high reflectance at room temperature, further comprising the steps: establishing a start condition only if reflectances of the first (9) and second (10) regions are low respectively high during the same sensing cycle.

11. The method for operating a container sensing system as claimed in claim 9, further comprising the steps of: detecting a development of smoke or flames in the oven cavity by said first transmitter/receiver pair (14, 15) establishing a change of received light from said first permanent reflectance region (9).

* * * * *